US005975724A

United States Patent [19]

Pallanes

[11] Patent Number: 5,975,724

[45] Date of Patent: Nov. 2, 1999

[54] LIGHTING FIXTURE WITH CONVERTIBLE SHADE HAVING A WALL WITH DETACHABLE INSERTS OF OPAQUE, TRANSLUCENT, OR CLEAR MATERIALS

[76] Inventor: James J. Pallanes, 17031 N. 11th Ave., Phoenix, Ariz. 85023

[21] Appl. No.: 09/030,354

[22] Filed: Feb. 25, 1998

[51] Int. Cl.[6] ..... F21V 7/00

[52] U.S. Cl. ..... 362/310; 362/351; 362/363; 362/355; 362/359; 362/361; 362/335; 362/455

[58] Field of Search ..... 362/363, 351, 362/355, 359, 361, 335, 455

[56] References Cited

U.S. PATENT DOCUMENTS 4,245,283 1/1981 Hahlen ..... 362/351
5,662,412 9/1997 Glendmyer ..... 362/351

*Primary Examiner*—Sandra O'Shea
*Assistant Examiner*—Ronald E. DelGizzi
*Attorney, Agent, or Firm*—Joihn D. Lister

[57] ABSTRACT

A lighting fixture includes a convertible shade which is supported relative to the light source to intercept light rays emitted by the light source in a selected direction or directions. The wall of the convertible shade has one or more wall inserts which can be selectively and easily secured to or detached from the convertible shade to alter the effect of the convertible shade on light rays from the light source which are directed at the location or locations of the wall insert(s) in the convertible shade without detaching the convertible shade from the shade supporting means. Preferably, the convertible shade is made of an opaque material while the insert(s) may be made of opaque, translucent or clear materials.

20 Claims, 2 Drawing Sheets

LIGHTING FIXTURE WITH CONVERTIBLE SHADE HAVING A WALL WITH DETACHABLE INSERTS OF OPAQUE, TRANSLUCENT, OR CLEAR MATERIALS

BACKGROUND OF THE INVENTION

The present invention relates to convertible shades for lighting fixtures, such as floor lamps, table lamps, desk lamps and certain wall mounted lamps wherein the shade is located generally above the light source of the lighting fixture, and, in particular, to convertible shades which are provided with one or more wall inserts that can be easily secured to or detached from the walls of the convertible shades to alter the effect of the convertible shades on light rays emanating from the light source(s) of the lighting fixtures and to lighting fixtures including such convertible shades.

The present invention provides a unique convertible shade that enables the lighting effects of floor, table, desk and certain wall mounted lamps to be easily and dramatically altered. Normally, floor, table, desk and wall lamps with shades above the light source are made to redirect any upward light rays from the light source in a generally downward direction to focus or concentrate the light rays where a person using the light source most needs the light to perform tasks such as reading, writing, playing board or card games, etc. and such shades thereby perform a valuable function. However, there may be times when it is desired to change the lighting effects of such a floor, table, desk or wall lamp for fulfilling functions other than reading, writing, playing board or card games, etc., such as, for parties, general overall room illumination, etc., by allowing at least some of the generally upwardly directed light rays from the light source(s) to reflect off of the ceiling and/or walls of a room including the formation of various regular or irregular patterns of light on the ceiling and/or wall. The convertible shade of the present invention provides an easily convertible shade for such floor, table, desk and wall lamps that can be used to redirect all of the light rays emanating in a general upward direction or directions from light source(s) of such a lighting fixture in a generally downward direction or permit at least some of the light rays from the light source(s) to pass through the shade and onto a ceiling and/or wall(s) for aesthetic or other reasons.

SUMMARY OF THE INVENTION

The present invention relates to a convertible shade for a floor, table, desk or wall lamp (lighting fixture) and a lighting fixture that includes such a convertible shade which is supported generally above the light source(s) of the lighting fixture to intercept light rays emitted by the light source(s) in a selected generally upward direction or directions (in directions above the horizontal). The wall of the convertible shade has one or more wall inserts which can be selectively and easily secured to or detached from the convertible shade to alter the effect of the convertible shade on light rays from the light source(s) of the lighting fixture which are directed at the location or locations of the wall insert(s) in the convertible shade without detaching the convertible shade from the shade supporting means of the lighting fixture. With the insert or inserts in place, the convertible shade redirects the generally upwardly emitted light rays from the light source downward for reading, writing and other typical functions requiring the light to be directed downwardly to perform a task. With the insert or inserts removed, portions of the upwardly emitted light rays from the light source(s) can pass through the opening or openings from which the inserts have been removed to illuminate portions of a wall and/or ceiling.

Preferably, the convertible shade is made of an opaque material while the insert(s) may be made of opaque, translucent or clear materials. In addition, the insert(s) can have various geometrical configurations, such as but not limited to, round, oval, triangular, square, rectangular, hexagonal, octagonal, etc. and other configurations, such as but not limited to, figures of objects, animals, unique or original designs, etc. Insert(s) of desired or selected configuration(s) can be sized to project image(s) of the selected configuration(s) of the desired size(s) onto a ceiling and/or wall(s). Where a colored translucent or colored clear insert is used, the projected image can be of a desired color and where a colored translucent or colored clear insert is substituted for an opaque insert, the substitution of the translucent or clear colored insert for the opaque insert not only permits light to pass through the convertible shade, but provides the light projected through the shade with color or colors.

As used herein, the term "opaque material" refers to a material that is impervious to light rays. As used herein, the term "translucent material" refers to a material that transmits and diffuses light rays so that objects beyond the material can not be seen clearly through the material. As used herein, the term "clear material" refers to a material that is transparent, whether or not colored, so that objects beyond the material can be seen essentially without distortion.

DESCRIPTION OF THE PREFERRED EMBODIMENTS

Figure 1:
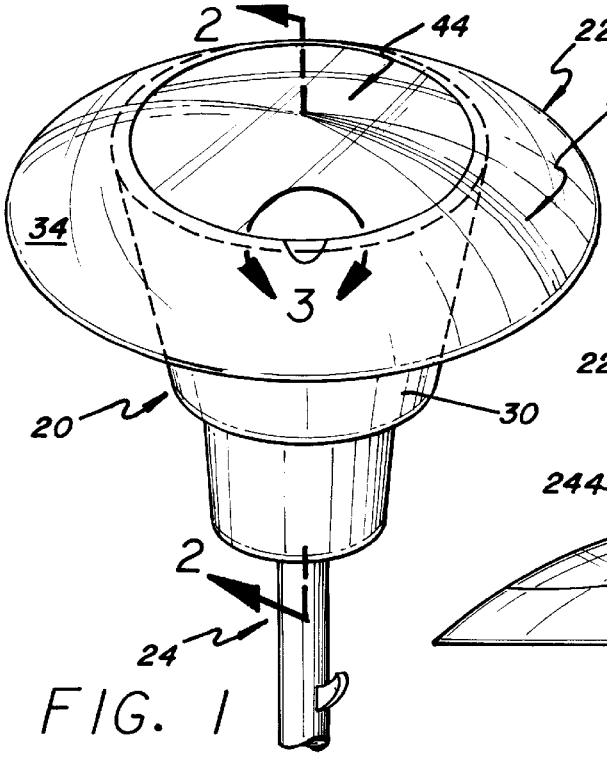
FIG. 1 is a partial perspective view of a light fixture of the present invention including a convertible shade.
Figure 7:
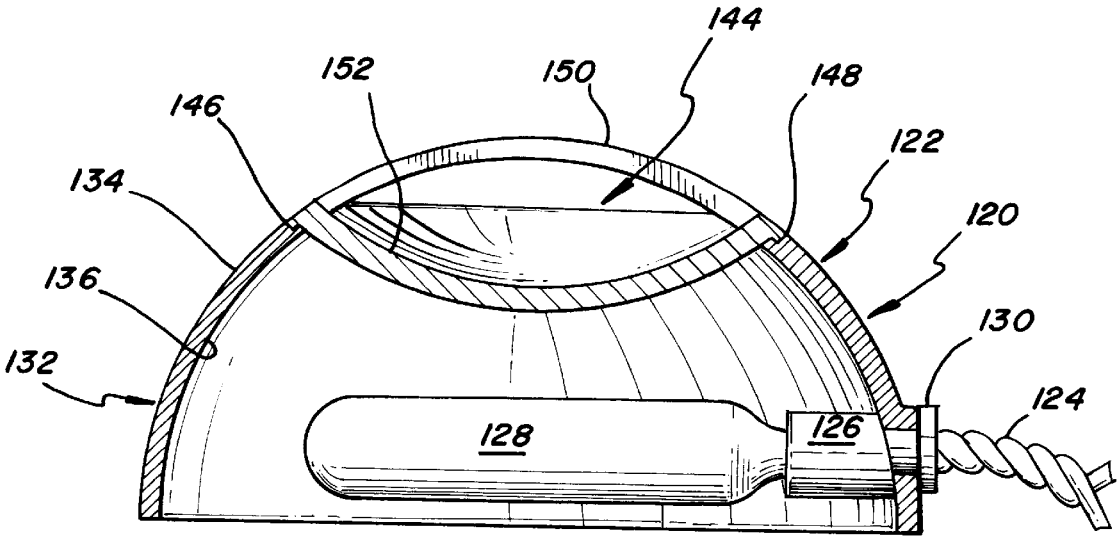
FIG. 7 is a vertical section of the light fixture of FIG. 6, taken substantially along lines 7—7 of FIG. 6.

FIGS. 1 and 7 illustrate two different lighting fixtures 20 and 120 which include a convertible shade 22 and 122 of the present invention. As discussed above, the lighting fixtures of the present invention are the type of lighting fixtures which normally have opaque shades located generally above the light sources of the lighting fixtures that redirect generally upwardly emitted rays from the light sources in a generally downward direction. The convertible shades of the present invention, as represented by the embodiments 22, 122, 222, 322, shown in FIGS. 1–7, have one or more wall inserts that can be selectively and easily mounted on or secured to the wall of the convertible shade and selectively and easily removed from or detached from the wall of the convertible shade while the convertible shade remains supported on the lighting fixture.

Figure 3:
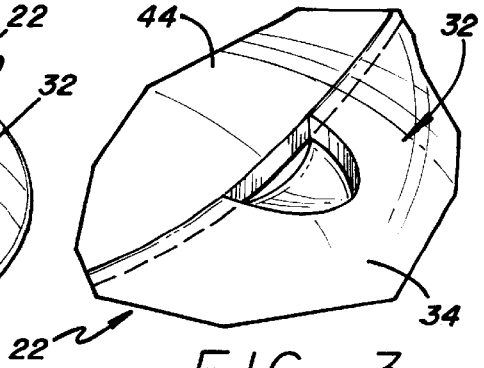
FIG. 3 is a detail of the portion 3 circled in FIG. 1, to better illustrate a means for facilitating the removal of a wall insert from the convertible shade.
Figure 2:
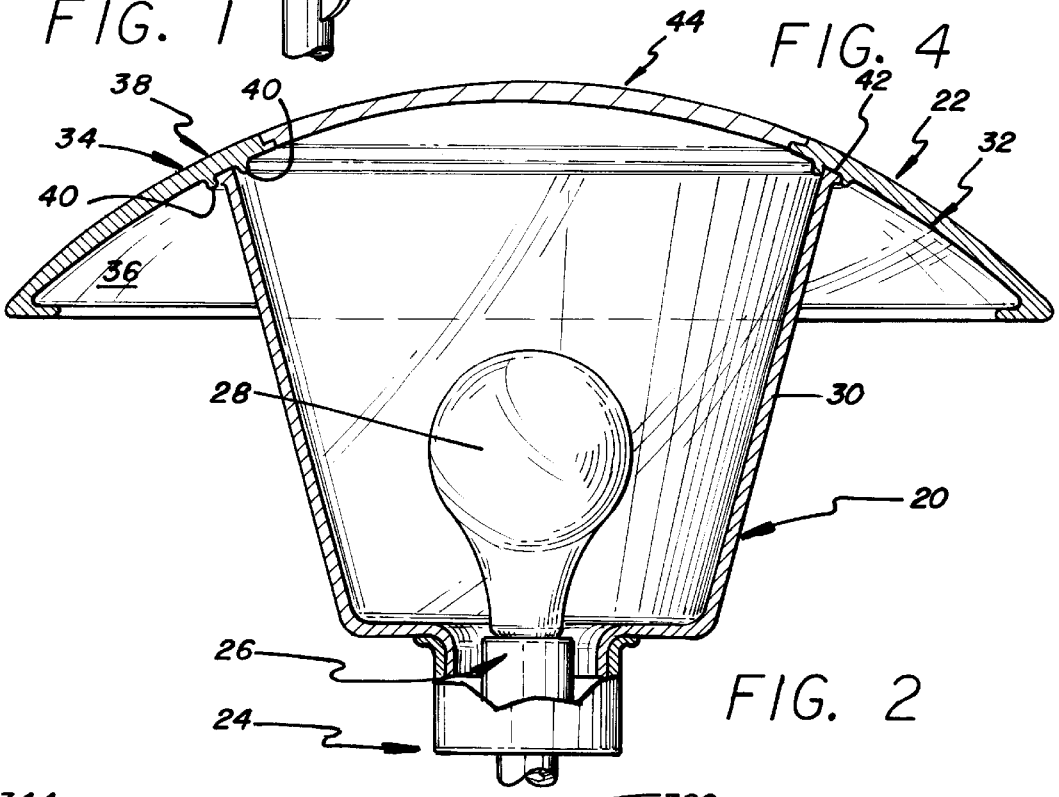
FIG. 2 is a vertical section through the light fixture of FIG. 1, taken substantially along lines 2—2 of FIG. 1.

In the embodiment of the convertible shade of the present invention 22, shown in FIGS. 1–3, the convertible shade 22 is shown supported on a lighting fixture 20 such as a floor, table or similar lamp having a rigid stem or shaft 24 extending upward from a base (not shown). The lighting fixture 20 is provided with a conventional light socket 26 at the upper end of the shaft or stem 24 in which is mounted a lighting source 28 (one or more conventional light bulbs), and a lens or globe 30 which directly supports the convertible shade 22. It should be noted that while the convertible shade 22 is shown supported directly on the lens or globe 30, the convertible shade 22 can be supported on the lighting fixture 20 by other conventional means such as but not limited to spokes or rods extending upwardly from upper portion of the stem or shaft 24 adjacent the light socket 26 to conventional anchoring means such as but not limited to recesses in the wall of the convertible shade, and that the lighting fixture does not have to include a lens or globe 30 around the light source 28.

As shown, the wall 32 of the convertible shade 22 has a generally convex outer upper surface 34 and a generally concave inner lower surface 36. An annular channel 38 formed by a pair of spaced apart annular ribs 40 in the lower surface of the convertible shade 22 receive the upper annular edge 42 of the lens or globe 30 to support the convertible shade on the lighting fixture 20. The convertible shade 22 includes a wall insert 44 that is mounted to or secured within an opening in the wall 32 of the convertible shade. Preferably, the outer edge 46 of the wall insert 44, which as shown is annular in configuration, and the inner edge 48 of the opening in the wall 32 are complementary so that no light passes between the outer edge of the wall insert 44 and the wall opening when the wall insert 44 is in place. As shown, the outer edge 46 of the wall insert 44 and the inner edge 48 of the wall opening have stepped edges which are complementary with respect to each other to firmly hold or secure the wall insert in place within the wall opening when the wall insert 44 is mounted on or secured to the convertible shade. Preferably, the convertible shade has a means for facilitating the easy removal of the wall insert 44 from the opening, such as, but not limited to, the recess 50 shown at the edge of the wall opening in FIGS. 1 and 3 which can receive the end of a finger or other means for removing or detaching the wall insert 44 from the convertible shade 22 and a hook 52 or other means for holding the wall insert after it has been removed from the opening so that wall insert 44 is readily available to be remounted on the convertible shade 22 when desired.

Figure 6:
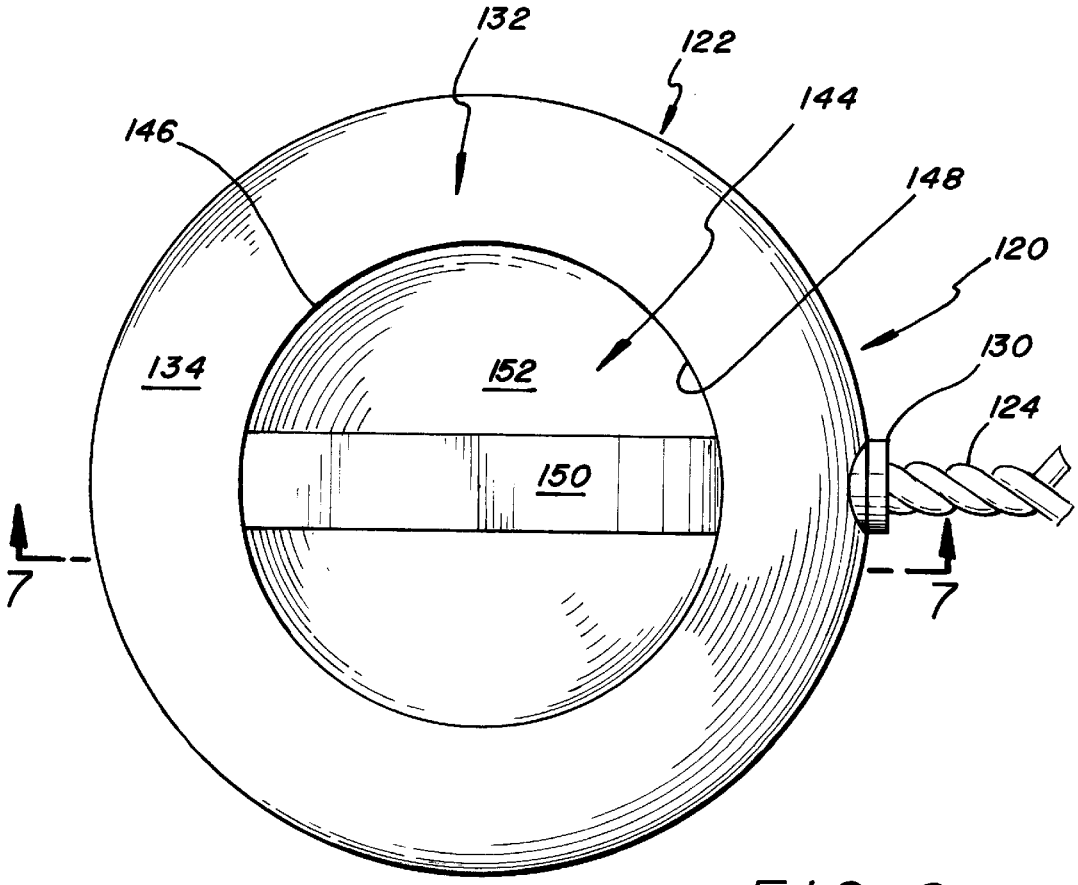
FIG. 6 is a plan view of a light fixture of the present invention including a convertible shade provided with a wall insert than includes a handle to facilitate the handling of the wall insert.

FIGS. 6 and 7 show a lighting fixture 120 such as but not limited to a desk or table lamp. The lighting fixture 120 includes a convertible shade 122 and has a flexible stem or shaft 124 extending generally upward from a base (not shown). The lighting fixture 120 is provided with a conventional light socket 126 at the upper end of the flexible shaft or stem 124 in which is mounted a lighting source 128 (one or more conventional light bulbs). As shown, the convertible shade 122 is supported on the upper end of the flexible stem or shaft 125 by a nut 130 or similar conventional fastener which secures the convertible shade 122 to an end of the light socket 126.

As shown, the wall 132 of the convertible shade 122 has a generally convex outer upper surface 134 and a generally concave inner lower surface 136. The convertible shade 122 includes a wall insert 144 that is mounted to or secured within an opening in the wall 132 of the convertible shade. Preferably, the outer edge 146 of the wall insert 144, which as shown is annular in configuration, and the inner edge 148 of the opening in the wall 132 are complementary so that no light passes between the outer edge of the wall insert 144 and the wall opening when the wall insert 144 is in place. As shown, the outer edge 146 of the wall insert 144 and the inner edge 148 of the wall opening have stepped edges which are complementary with respect to each other to firmly hold or secure the wall insert in place within the wall opening when the wall insert 144 is mounted on or secured to the convertible shade 122. Preferably, the convertible shade has a means for facilitating the easy removal of the wall insert 144 from the opening, such as, but not limited to, a handle 150 which is integral with the wall insert and extends diametrically across the wall insert above a recess 152 in the wall insert. The spacing between the handle 150 and the surface of the recess 152 is such that a person's fingers or other means can be passed beneath the handle to grip the handle 150 for removing or detaching the wall insert 144 from the convertible shade 122 and replacing the wall insert 144 on the convertible shade 122. By spacing the handle 150 above the recessed surface of the wall insert 144, the handle does not become overheated by the light source 128 and remains cool enough to remove with the hand even when the lighting fixture 120 is in use.

Figure 4:
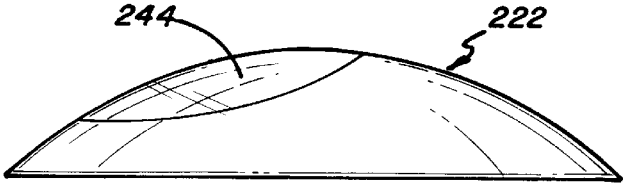
FIG. 4 is an elevation of a convertible shade of the present invention with an wall insert located off center.
Figure 5:
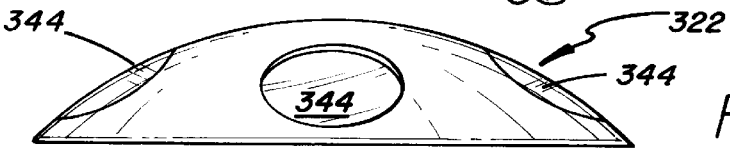
FIG. 5 is an elevation of a convertible shade of the present invention with a plurality of wall inserts.

While the wall inserts 44 and 144 are shown centered over the light source, the wall inserts of the convertible shades of the present invention can be offset from the centers of the convertible shades such as the wall insert 244 of convertible shade 222 shown in FIG. 4 and the plurality of wall inserts 344 of the convertible shade 322 shown in FIG. 5. The structures of the outer edges of the wall inserts 244 and 344 and the inner edges of the openings in the convertible shades 222 and 322 are identical or similar to those of the wall inserts 44 and 144 of and the openings in convertible shades 22 and 122 to prevent the passage of light between the wall inserts and the openings when the wall inserts are in place.

As discussed above in the summary of the invention, preferably, the convertible shades 22, 122, 222 and 322 are made of opaque materials while the wall insert(s) 44, 144, 244 and 344 may be made of opaque, translucent or clear materials. In addition, the wall insert(s) can have various geometrical configurations, such as but not limited to, round, oval, triangular, square, rectangular, hexagonal, octagonal, etc. and other configurations, such as but not limited to, figures of objects, animals, unique or original designs, etc. The insert(s) 44, 144, 244 and 344 [of desired or selected configuration(s)] can be sized to project image(s) of the selected configuration(s) of the desired size(s) onto a ceiling and/or wall(s) at a given distance from the lighting fixture. Where a colored translucent or colored clear wall insert is used, the projected image can be of a desired color and where a colored translucent or colored clear wall insert is substituted for an opaque wall insert, the substitution of the translucent or clear colored wall insert for the opaque wall insert not only permits light to pass through the convertible shade, but provides the light projected through the convertible shade with color or colors.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A lighting fixture comprising:

a light source;

shade supporting means for supporting a shade relative to the light source to intercept light rays emitted by the light source; and a convertible shade supported by the shade supporting means; the convertible shade having a wall for intercepting light rays emitted by the light source in a selected direction; and the convertible shade having a wall insert which can be selectively and easily secured to or detached from the convertible shade to alter the effect of the convertible shade on light rays from the light source which are directed at location of the wall insert in the convertible shade without detaching the convertible shade from the shade supporting means.

2. The lighting fixture according to claim 1, wherein: the wall of the convertible shade, including the wall insert, is opaque.

3. The lighting fixture according to claim 1, wherein: the wall of the convertible shade, except for the wall insert, is opaque.

4. The lighting fixture according to claim 3, wherein: the wall insert is made of a material selected from a group consisting of: translucent materials and clear, colored materials.

5. The lighting fixture according to claim 1, wherein: the convertible shade has a plurality of wall inserts which can be selectively secured to or detached from the convertible shade to alter the effect of the convertible shade on light rays from the light source which are directed at locations of the wall inserts in the convertible shade without detaching the convertible shade from the shade supporting means.

6. The lighting fixture according to claim 1, wherein: the convertible shade is supported relative to the light source so that the wall of the convertible shade intercepts light rays from the light source directed in a generally upward direction.

7. The lighting fixture according to claim 1, wherein: the wall of the convertible shade has a generally concave inner surface a generally convex outer surface, and a lower generally annular outer edge; the convertible shade is supported relative to the light source so that the wall of the convertible shade is generally above the light source; and the wall insert has a handle to facilitate the placement of the wall insert on the convertible shade for securement to the convertible shade and the detachment of the wall insert from the convertible shade.

8. The lighting fixture according to claim 7, wherein: the wall insert is generally centered over the light source.

9. The lighting fixture according to claim 7, wherein: the wall insert is located off center from the light source.

10. The lighting fixture according to claim 7, wherein: the convertible shade has a plurality of wall inserts which can be selectively secured to or detached from the convertible shade to alter the effect of the convertible shade on light rays from the light source which are directed at locations of the wall inserts in the convertible shade without detaching the convertible shade from the shade supporting means; and at least one of the wall inserts is located off center from the light source.

11. A convertible shade for a lighting fixture comprising:

a convertible shade having means for mounting the convertible shade to a shade supporting means of a light fixture for supporting the convertible shade relative to a light source of the light fixture to intercept light rays emitted by the light source; and the convertible shade having a wall for intercepting light rays emitted by the light source in a selected direction; and the convertible shade having a wall insert which can be selectively and easily secured to or detached from the convertible shade to alter the effect of the convertible shade on light rays from the light source which are directed at location of the wall insert in the convertible shade without detaching the convertible shade from the shade supporting means.

12. The lighting fixture according to claim 11, wherein: the wall of the convertible shade, including the wall insert, is opaque.

13. The lighting fixture according to claim 11, wherein: the wall of the convertible shade, except for the wall insert, is opaque.

14. The lighting fixture according to claim 13, wherein: the wall insert is made of a material selected from a group consisting of: translucent materials and clear, colored materials.

15. The lighting fixture according to claim 11, wherein: the convertible shade has a plurality of wall inserts which can be selectively secured to or detached from the convertible shade to alter the effect of the convertible shade on light rays from the light source which are directed at locations of the wall inserts in the convertible shade without detaching the convertible shade from the shade supporting means.

16. The lighting fixture according to claim 11, wherein: the convertible shade is supported relative to the light source so that the wall of the convertible shade intercepts light rays from the light source directed in a generally upward direction.

17. The lighting fixture according to claim 11, wherein: the wall of the convertible shade has a generally concave inner surface a generally convex outer surface, and a lower generally annular outer edge; the convertible shade is supported relative to the light source to that the wall of the convertible shade is generally above the light source; and the wall insert has a handle to facilitate the placement of the wall insert on the convertible shade for securement to the convertible shade and the detachment of the wall insert from the convertible shade.

18. The lighting fixture according to claim 17, wherein: the wall insert is generally centered over the light source.

19. The lighting fixture according to claim 17, wherein: the wall insert is located off center from the light source.

20. The lighting fixture according to claim 17, wherein: the convertible shade has a plurality of wall inserts which can be selectively secured to or detached from the convertible shade to alter the effect of the convertible shade on light rays from the light source which are directed at locations of the wall inserts in the convertible shade without detaching the convertible shade from the shade supporting means; and at least one of the wall inserts is located off center from the light source.

* * * * *